US008350647B2

(12) United States Patent
Takaya et al.

(10) Patent No.: US 8,350,647 B2
(45) Date of Patent: Jan. 8, 2013

(54) ELECTROMAGNETIC CONTACT DEVICE

(75) Inventors: Kouetsu Takaya, Kounosu (JP); Koji Okubo, Kumagaya (JP); Yasuhiro Naka, Kounosu (JP); Toshikatsu Ohgami, Kounosu (JP); Kenji Suzuki, Kounosu (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/138,927

(22) PCT Filed: Jun. 14, 2010

(86) PCT No.: PCT/JP2010/003935

§ 371 (c)(1),
(2), (4) Date: Jan. 4, 2012

(87) PCT Pub. No.: WO2011/021333

PCT Pub. Date: Feb. 24, 2011

(65) Prior Publication Data

US 2012/0112858 A1 May 10, 2012

(30) Foreign Application Priority Data

Aug. 20, 2009 (JP) ..... 2009-190585

(51) Int. Cl.
*H01H 63/02* (2006.01)

(52) U.S. Cl. ..... 335/133; 335/78; 335/128

(58) Field of Classification Search ..... 335/78, 335/128–138

See application file for complete search history.

(56) References Cited

U.S. PATENT DOCUMENTS

| | | | | |
|---|---|---|---|---|
| 5,081,436 | A * | 1/1992 | Nishi et al. | 335/83 |
| 6,377,143 | B1 * | 4/2002 | Zhou et al. | 335/132 |
| 6,424,242 | B1 * | 7/2002 | Shinoura et al. | 335/78 |
| 2005/0200439 | A1 * | 9/2005 | Kawahara et al. | 335/128 |
| 2012/0133460 | A1 * | 5/2012 | Okubo et al. | 335/132 |

FOREIGN PATENT DOCUMENTS

| | | |
|---|---|---|
| JP | U-H02-71937 | 5/1990 |
| JP | U-H03-2543 | 1/1991 |
| JP | H04-233115 | 8/1992 |
| JP | H06-310010 | 11/1994 |
| JP | 2001-014992 | 1/2001 |

* cited by examiner

*Primary Examiner* — Bernard Rojas
(74) *Attorney, Agent, or Firm* — Manabu Kanesaka

(57) ABSTRACT

A plurality of terminal chambers (20*a*) to (20*e*) is formed in a housing (16) by using a plurality of partition walls (24*a*) to (24*e*) to partition. In the terminal chambers, fixed contactors (31) each having a fixed contact point (31*d*) and a terminal screw (31*a*) are mounted. Engaged portions (31*b*) are formed integrally with the fixed contactors. Further, a press-fit engaging portion (26) is provided in each of the terminal chambers. The terminal chamber is formed as a space different from a space accommodating a movable contact point support, and the press-fit engaging portion is engaged by the engaged portion by press-fitting.

10 Claims, 13 Drawing Sheets

ELECTROMAGNETIC CONTACT DEVICE

RELATED APPLICATIONS

The present application is National Phase of International Application No. PCT/JP2010/003935 filed Jun. 14, 2010, and claims priority from, Japanese Application No. 2009-190585, filed Aug. 20, 2009.

TECHNICAL FIELD

The invention relates to an electromagnetic contact device, and more specifically relates to a structure for fixing a contactor device in a housing.

BACKGROUND ART

In an electromagnetic contact device, an electromagnet is accommodated in a first case, and a contact point portion is accommodated in a second case which is stacked on and connected to this first case.

The second case includes a plurality of terminal chambers on the power supply side and a plurality of terminal chambers on the load side, which are mutually opposed on the rear-face side; and a movable contact point support of a contact point portion which moves by application of a voltage to the windings of the electromagnet is accommodated in the space between the power supply-side and the load-side terminal chambers. And, each terminal chamber accommodates a fixed contact point and a fixed contactor comprising a terminal screw (see for example Patent Reference 1).

Devices of the prior art similar to that of Patent Reference 1 are shown in FIG. 11 through FIG. 13.

FIG. 11 shows a fixed contactor 1 used in a device of the prior art. This fixed contactor 1 is provided with a fixed contact point 1*c* on a first bent piece 1*b* formed to be bent from one side of a terminal screw 1*a*; a boss hole 1*e* is formed in a second bent piece 1*d* formed to be bent from another side of the terminal screw 1*a*, and a press-fit claw 1*f* is formed on an end of the first contact piece 1*b*.

As shown in FIG. 12, in the second case 2, a plurality of terminal chambers 4*a* to 4*d* is formed by means of a plurality of partition walls 3*a* to 3*d*, separated and parallel; and bosses 6 are formed in outer walls perpendicularly intersecting the terminal bases 5 of these terminal chambers 4*a* to 4*d*. Here, as also shown in FIG. 13, the terminal chambers 4*a* to 4*d* communicate with an accommodation space 8 accommodating a movable contact point support 7. And, the fixed contactors 1 undergo an operation of dropping-in to the terminal chambers 4*a* to 4*d*, as indicated by the arrow with symbol A in FIG. 12, and an operation of pressing-in toward the accommodation space 8, as indicated by the arrow with symbol B. When pressing-in the fixed contactors 1, the press-fit claws 1*f* provided on an end of the first contact pieces 1*b* engage with recesses provided on the inner side after press-fitting into the terminal bases 5 (see FIG. 12), the bosses 6 mate with the boss holes 1*e* of the second contact pieces 1*d* and the fixed contactors 1 are installed, and the fixed contact points 1*c* of the fixed contactors 1 move up to the accommodation space 8 and oppose the movable contact points 9 arranged on the movable contact point support 7 (see FIG. 13).

Patent Reference 1: Japanese Patent Laid-open No. H6-310010

In the above-described second case 2, when a fixed contactor 1 is installed on a terminal base 5, the press-fit claw 1*f* of the fixed contactor 1 press-fitting onto the terminal base 5 shaves the surface of the terminal base 5, and shavings occur.

Here, the second case 2 communicates with the accommodation space 8 accommodating the terminal chambers 4*a* to 4*d* and the movable contact point support 8, so that if shavings enter into the accommodation space 8 which occur at the time of installation of a fixed contactor 1, there is the concern that a contact defect between a fixed contact point 1*c* and a movable contact point 9 may occur. Hence after installing the fixed contactor 1, air cleaning or similar is used to remove shavings. Hence in conventional installation of fixed contactors 1, a shaving-removal task is necessary, which is a problem from the standpoint of task efficiency.

DISCLOSURE OF THE INVENTION

Further, in the second case 2, a boss 6 is formed as an escape prevention for the fixed contactor 1, and so there is a problem from the standpoint of manufacturing cost of the second case 2.

This invention has been made focusing on the above unresolved problems of examples of the prior art, and has as an object the provision of an electromagnetic contact device in which task efficiency can be improved and contact reliability of contact points can be enhanced by rendering the removal of shavings unnecessary even when shavings occur at the time of installation of a fixed contactor, and which enables reduced housing manufacturing costs.

In order to attain the above object, the electromagnetic contact device of one embodiment comprises a housing in which power supply-side terminals and load-side terminals are opposed to each other on a rear face side thereof, a movable contact point support is accommodated in a space between the terminals, a plurality of terminal chambers is formed by using a plurality of partition walls to partition, and fixed contactors each having a fixed contact point and a terminal screw are mounted as the terminals in the terminal chambers, wherein an engaged portion is formed integrally with each of the fixed contactors, and a press-fit engaging portion is formed in each of the terminal chambers as a space different from the space accommodating the movable, contact point support, and has the engage portion to be engaged by press-fitting.

By means of the electromagnetic contact device of this embodiment, a fixed contactor can be installed simply by press-fitting the engaged portion in one direction into the press-fit engaging portion formed in the terminal chambers, so that the number of installation processes is reduced.

Further, a press-fit engaging portion of a terminal chamber is formed as a space different from the space in which the movable contact point support is accommodated, so that an effect of shavings occurring upon press-fitting on the contact point on the movable contact point support side can be prevented.

Further, it is preferable that in the electromagnetic contact device of one embodiment, the press-fit engaging portion has an engaging wall forming a press-fit space of the engaged portion, and the engaged portion has an engaging tooth which is press-fit into the engaging wall.

By means of the electromagnetic contact device of this embodiment, the engaged portion of the fixed contactor is firmly press-fit into the press-fit engaging portion.

Further, in the electromagnetic contact device of one embodiment, a blocking portion for blocking the press-fit space, in which the engaged portion is press-fit into the press-fit engaging portion, may be provided in at least one of the engaged portion or the press-fit engaging portion.

By means of the electromagnetic contact device of this embodiment, shavings occur at the time of press-fitting of the engaging tooth of the engaged portion into the engaging wall of the press-fit engaging portion, but the shavings are sealed into the press-fit space by the blocking portion, so that removal of shavings by air cleaning or similar becomes unnecessary, and installation of the fixed contactor is made even easier.

Further, in the electromagnetic contact device of one embodiment, it is preferable that an escape-preventing portion, which prevents each of the fixed contactors in which the engaged portion is press-fit into the press-fit engaging portion from escaping in a direction opposite to a press-fitting direction, be provided.

By means of the electromagnetic contact device of this embodiment, escape of the fixed contactor can be reliably prevented, so that the reliability of the wiring terminal portion of the electromagnetic contact device is enhanced.

Further, in the electromagnetic contact device of one embodiment, it is preferable that a cover which blocks the space be installed on the housing, and a pressing portion, which abuts the terminal screw of each of the fixed contactors, and which functions as the escape-preventing portion, be provided on the cover.

By means of the electromagnetic contact device of this embodiment, a structure which prevents escape of the fixed contactor is obtained simply by installing a cover on a housing.

By means of the electromagnetic contact device of this invention, a fixed contactor is firmly mounted in a terminal chamber due to the pressing portion when the engaged portion is press-fitted into the press-fit engaging portion formed in the terminal chamber, so that escape of the fixed contactor can be reliably prevented even when a specialized portion for preventing escape is not formed in the housing.

Further, the press-fit engaging portion of a terminal chamber is formed as a space different from the space in which the movable contact point support is accommodated, so that an effect of shavings occurring upon press-fitting on the contact point on the movable contact point support side can be prevented, and the task of removing shavings and similar is rendered unnecessary, so that task efficiency is improved.

BEST MODE FOR CARRYING OUT THE INVENTION

Figure 1:
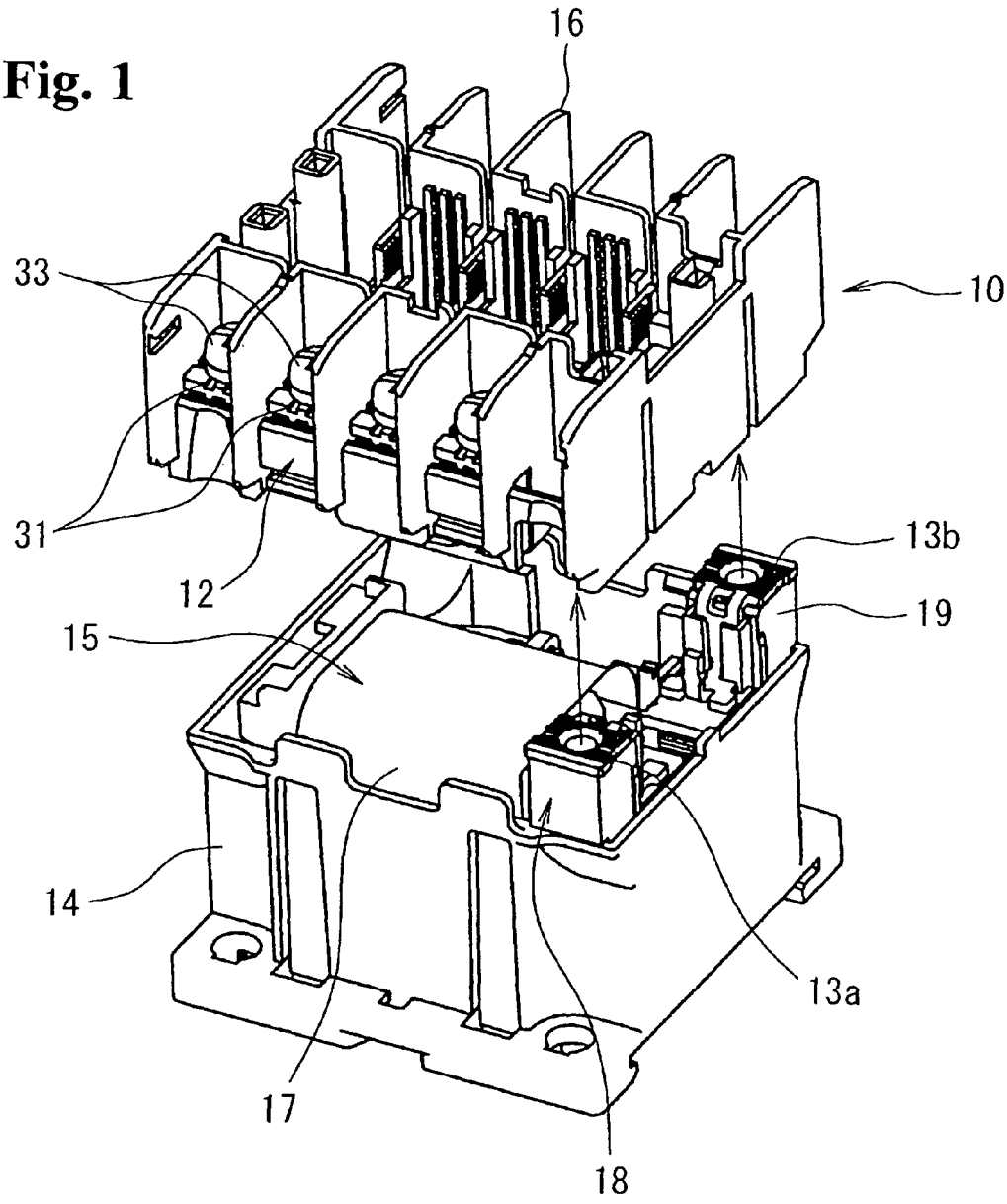
FIG. 1 is an exploded perspective view showing a lower case accommodating the electromagnet of an electromagnetic contact device and an upper case accommodating a contact point portion.

Below, preferred embodiments (hereafter "embodiments") for implementing an electromagnetic contact device of the invention are explained in detail, referring to the drawings.

Figure 2:
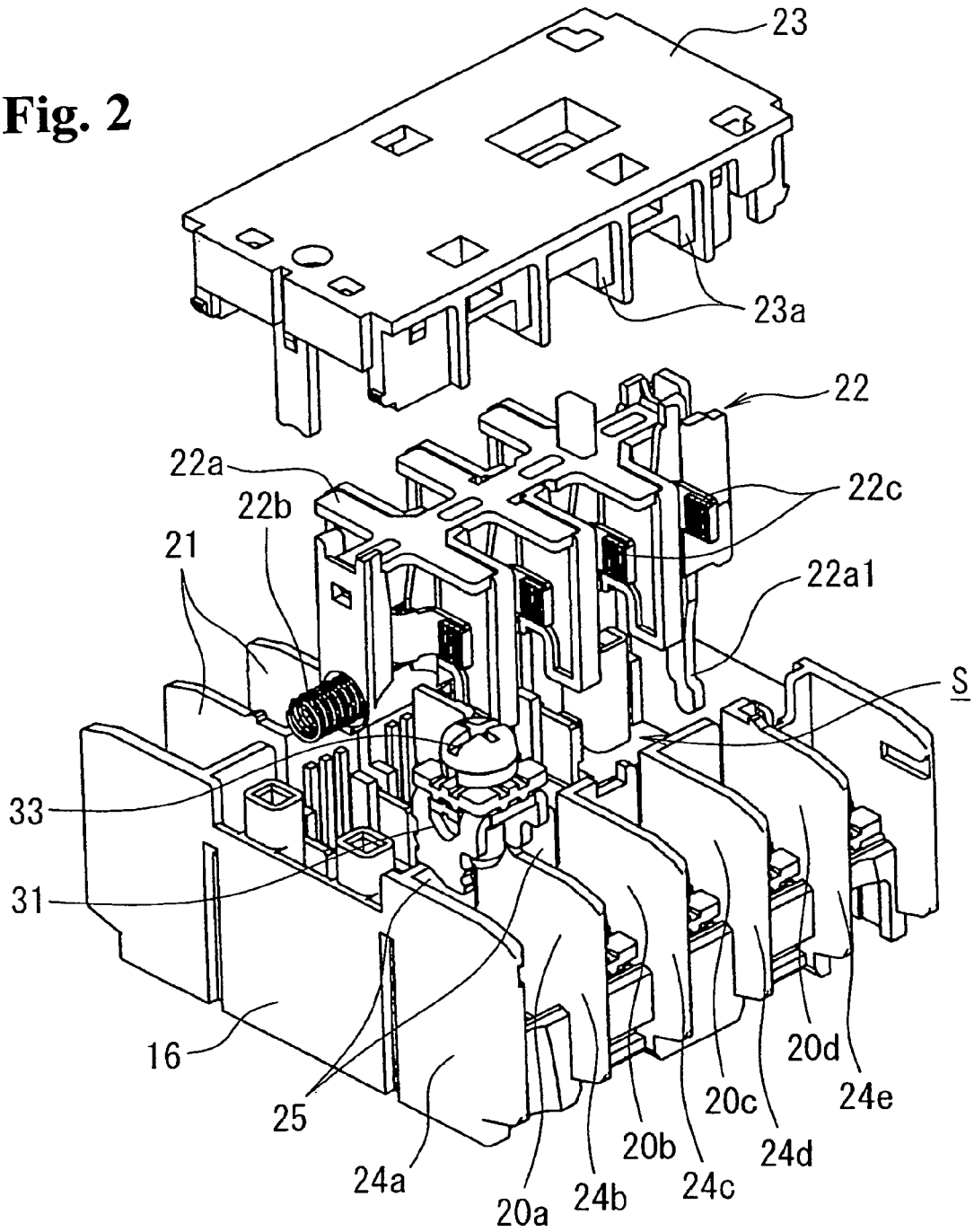
FIG. 2 is an exploded perspective view showing the structure of an upper case accommodating a contact point portion.
Figure 3:
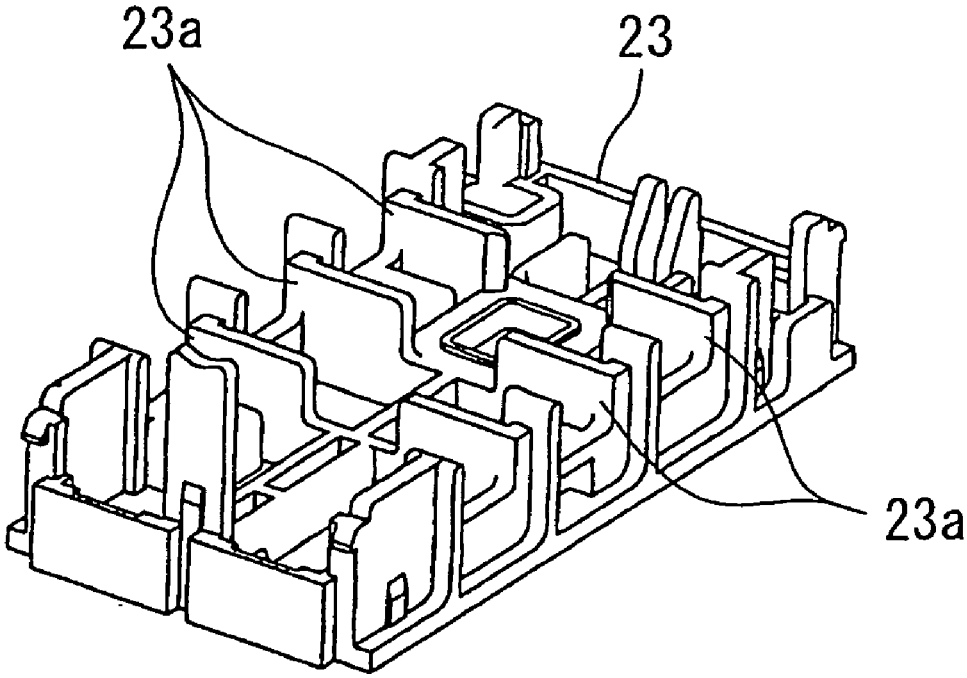
FIG. 3 shows the rear face shape of a cover mounted on an upper case.
Figure 4:
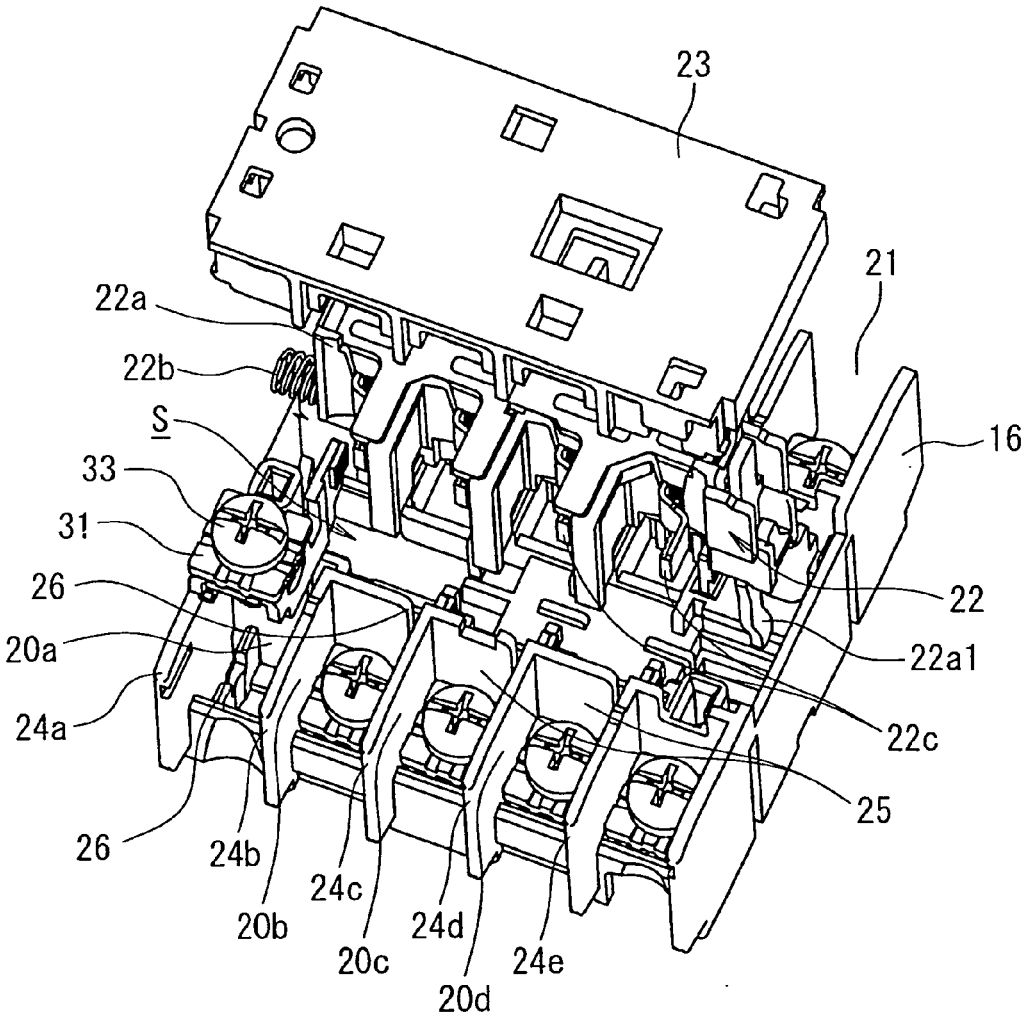
FIG. 4 is an exploded perspective view showing the structure of an upper case accommodating a contact point portion from a direction different from that in FIG. 2.
Figure 5:
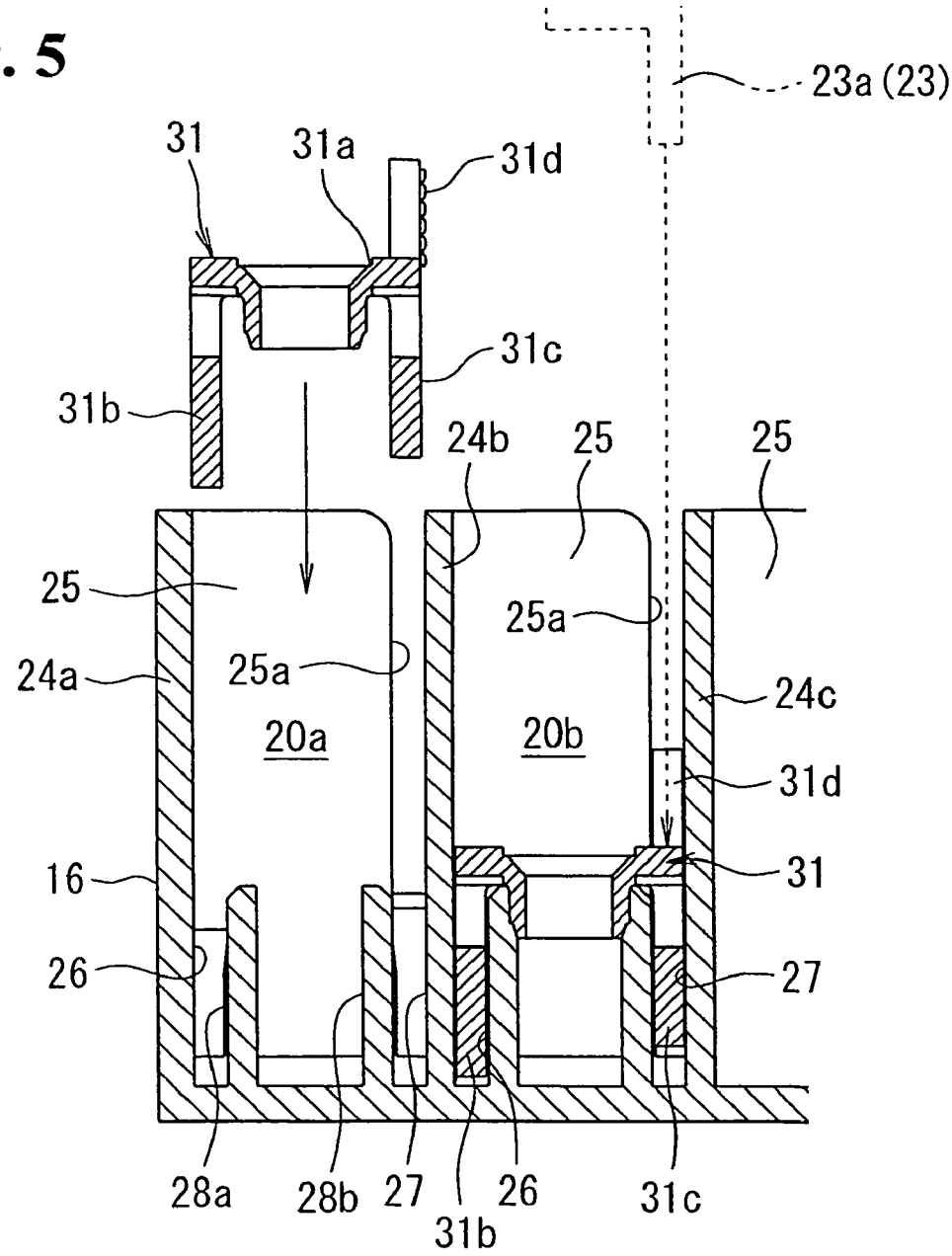
FIG. 5 shows a state of mounting a fixed contactor in a terminal chamber of an upper case.
Figure 6:
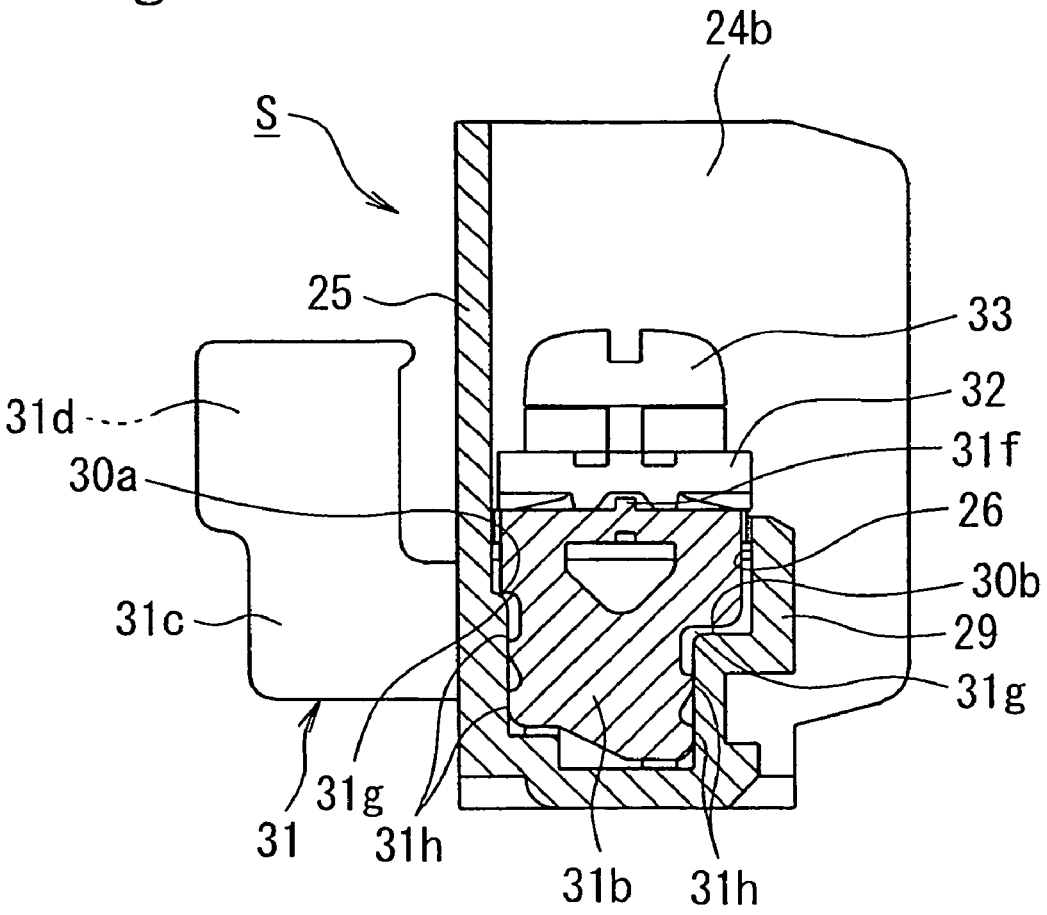
FIG. 6 shows principal portions of a terminal chamber in which is mounted a fixed contactor.
Figure 7B:
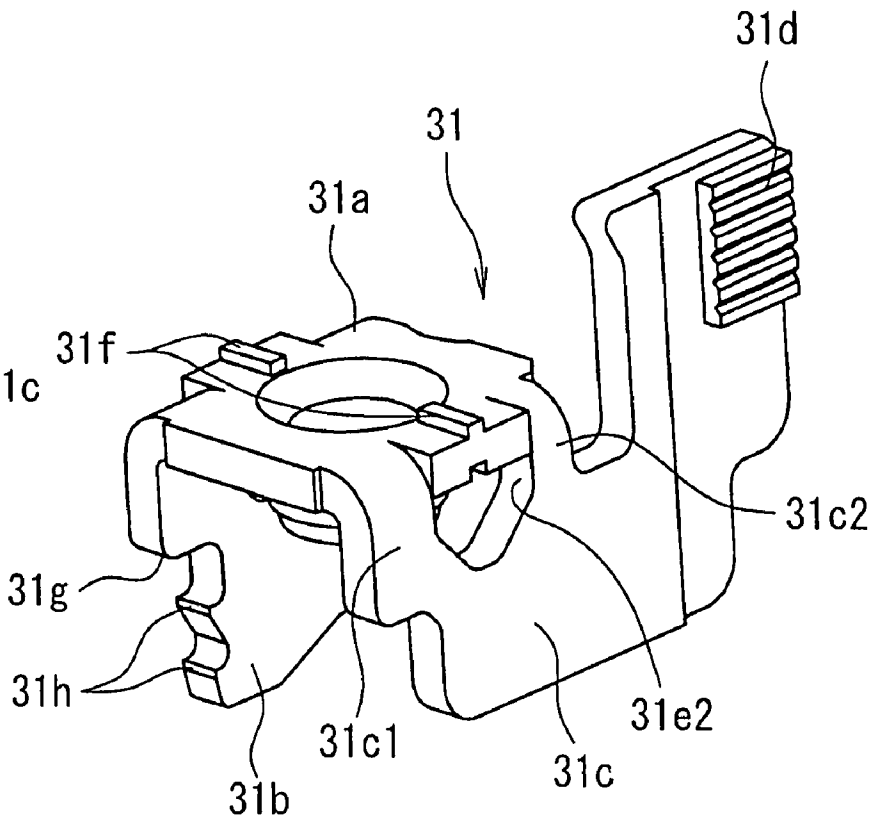
FIG. 7 shows the structure of a fixed contactor in one embodiment.
Figure 7A:
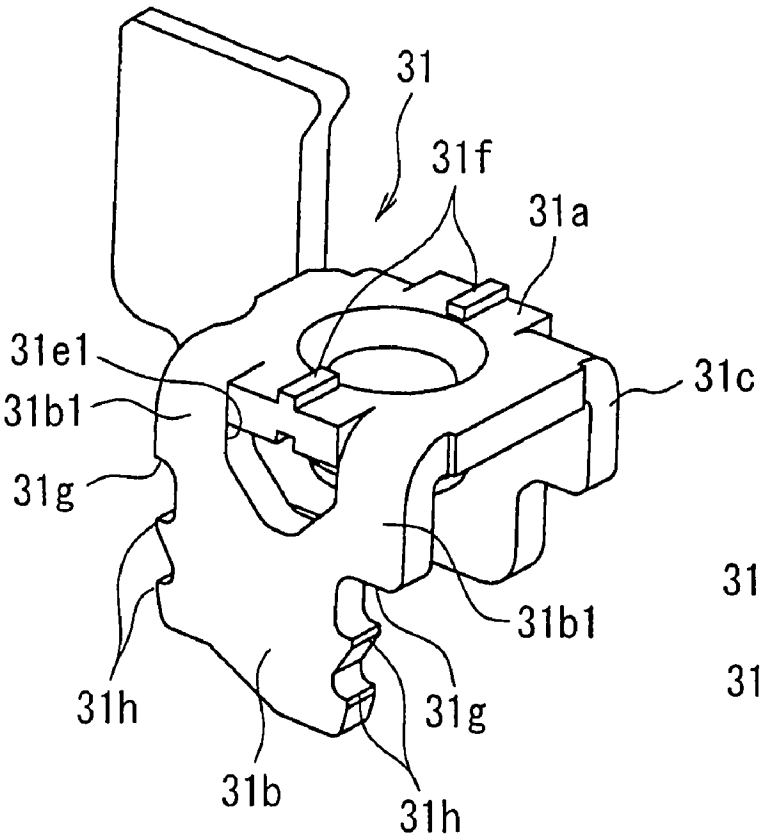
Figure 8B:
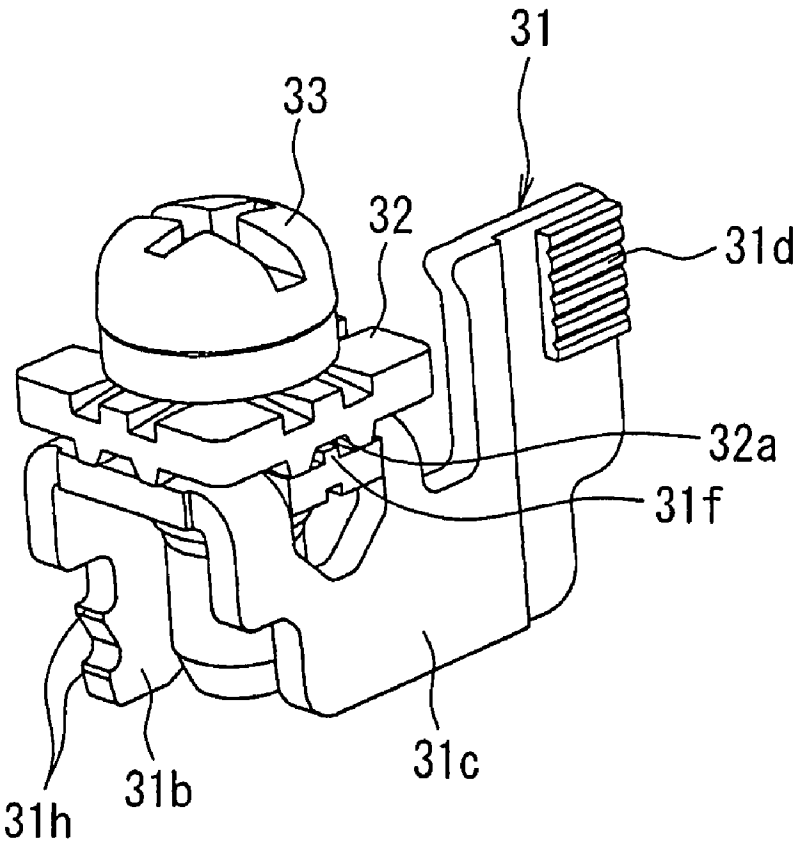
FIG. 8 shows a state in which a screw with a washer is screwed into a fixed contactor.
Figure 8A:
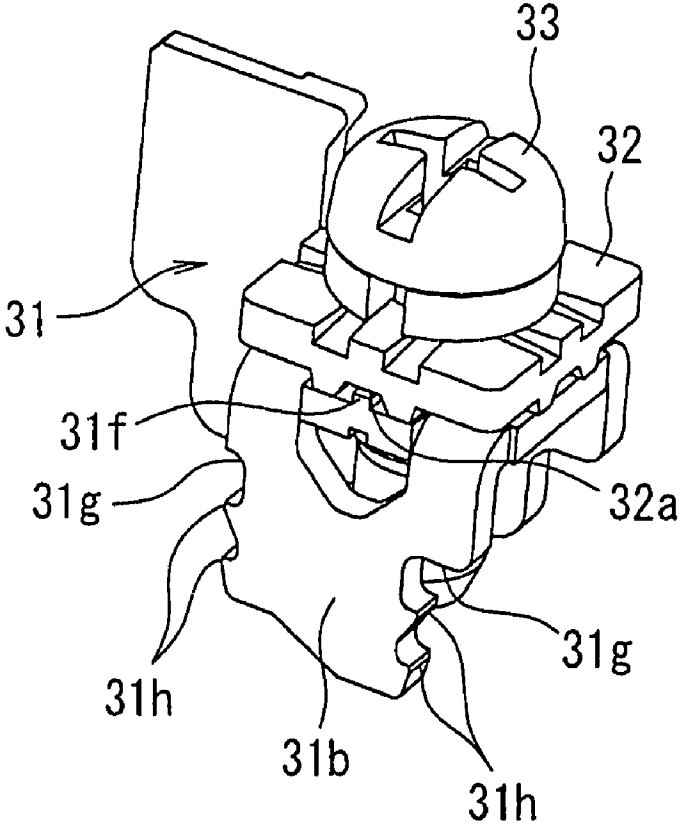
Figure 9B:
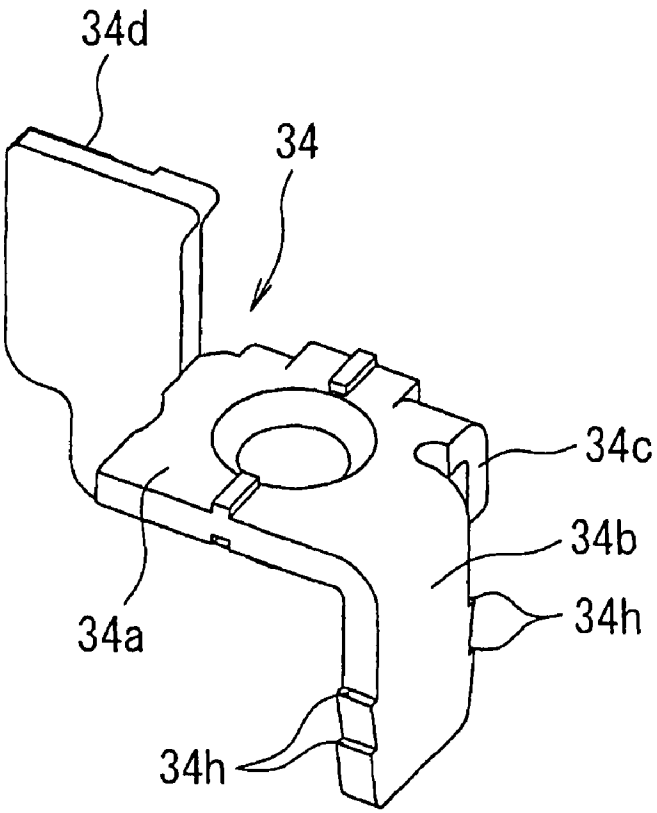
FIG. 9 shows the structure of the fixed contactor of an embodiment different from that of FIG. 7.
Figure 9A:
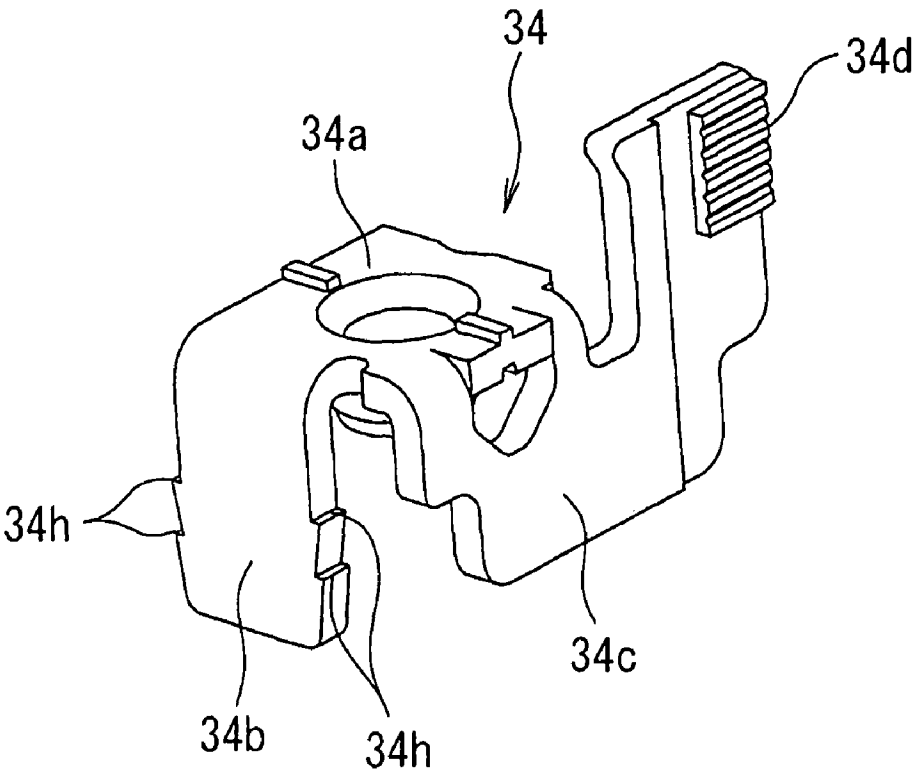
Figure 10B:
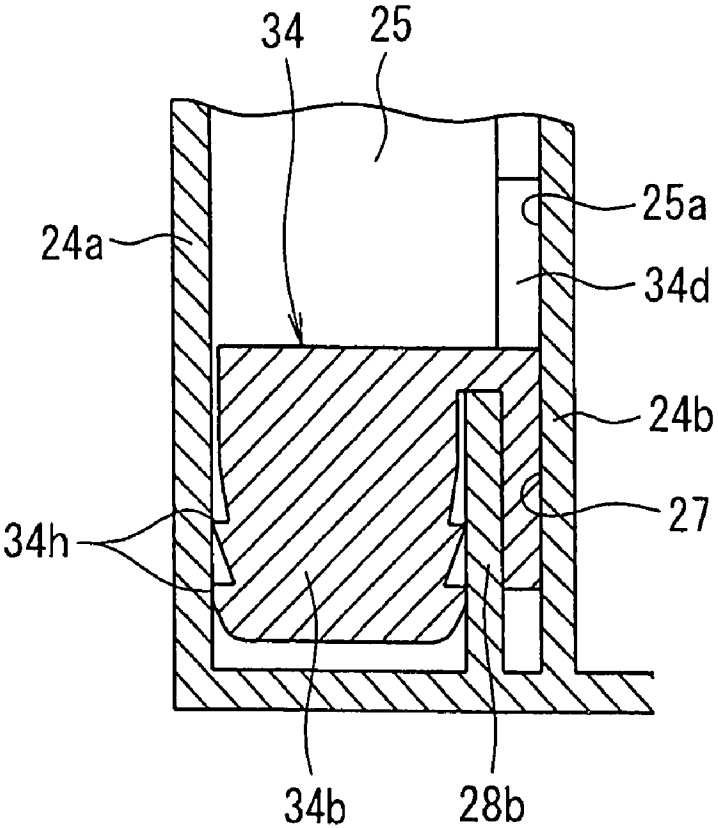
FIG. 10 shows a state in which the fixed contactor of FIG. 9 is mounted in a terminal chamber of an upper case.
Figure 10A:
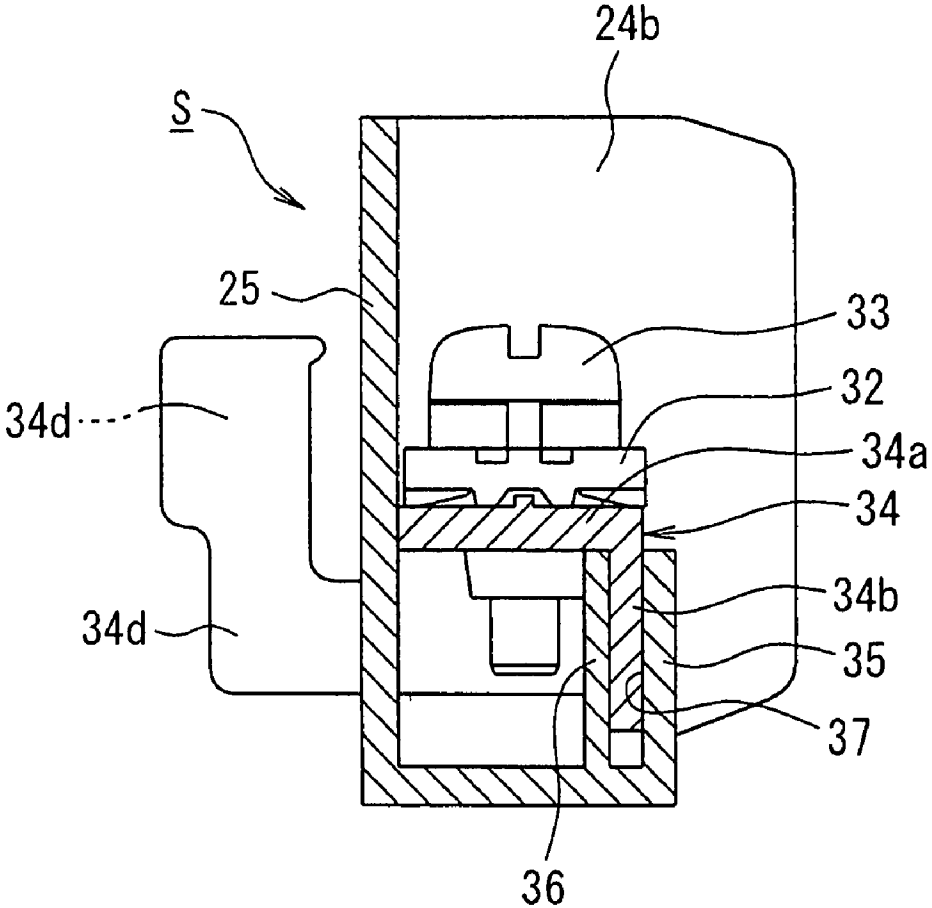
Figure 11:
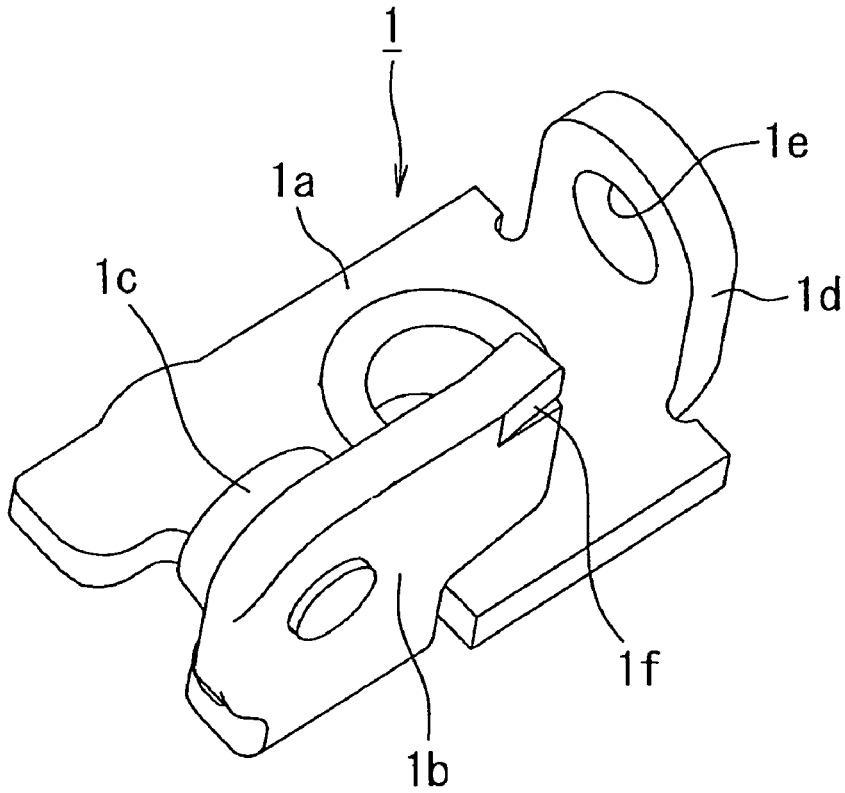
Fig. 11 Prior Art
FIG. 11 shows the structure of a fixed contactor of the prior art.
Figure 12:
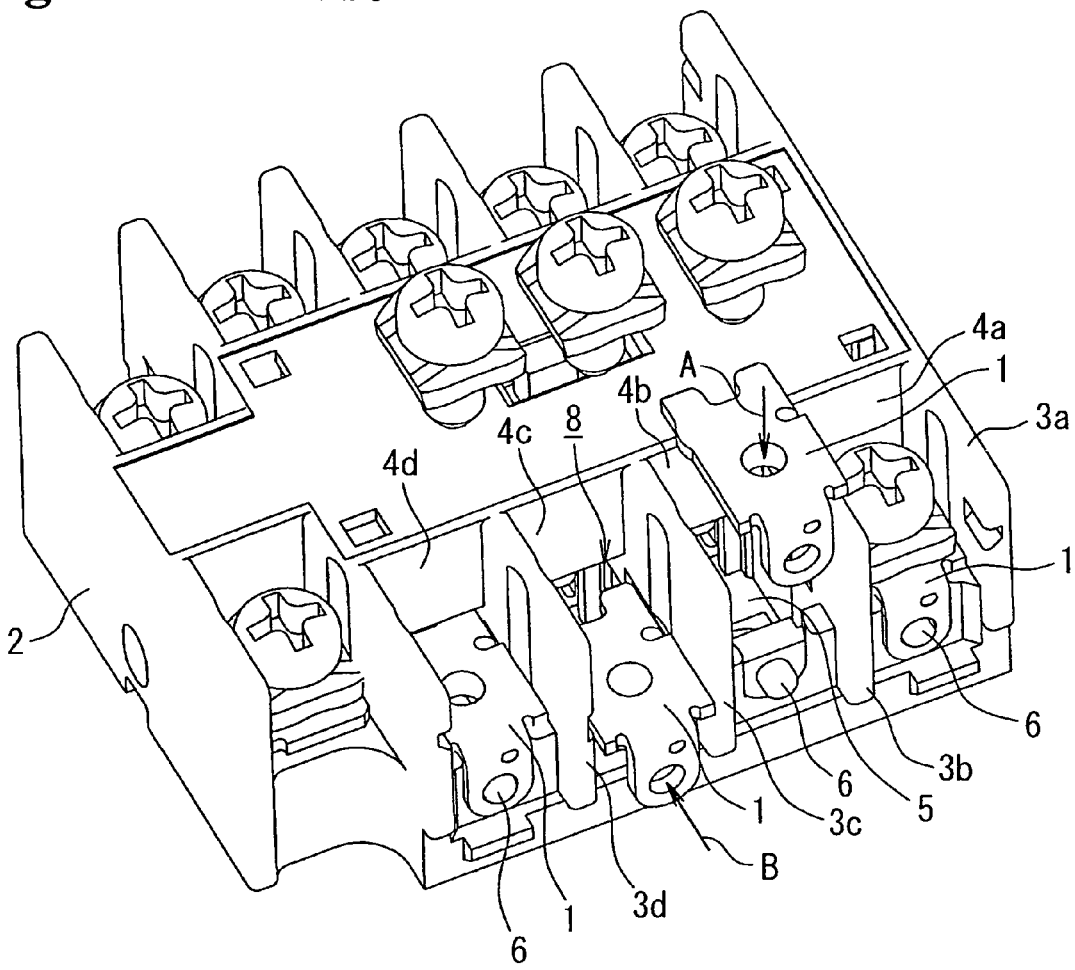
Fig. 12 Prior Art
FIG. 12 shows the upper cover of an electromagnetic contact device using a fixed contactor of the prior art.
Figure 13:
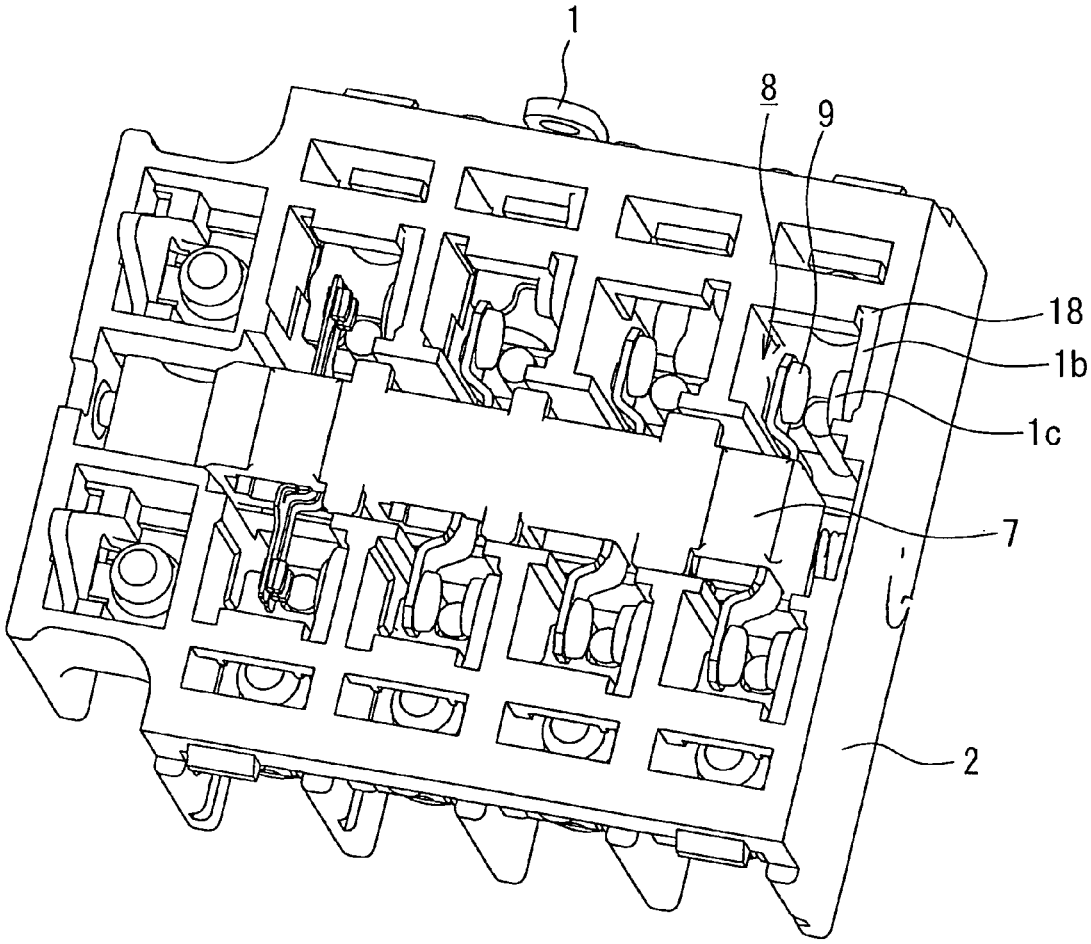
Fig. 13 Prior Art
FIG. 13 shows the upper cover of an electromagnetic contact device using a fixed contactor of the prior art from a different direction.

FIG. 1 is an exploded perspective view showing a lower case accommodating the electromagnet of an electromagnetic contact device and an upper case accommodating a contact point portion, FIG. 2 is an exploded perspective view showing the structure of an upper case accommodating a contact point portion, FIG. 3 shows the rear face shape of a cover mounted on an upper case, FIG. 4 is an exploded perspective view showing the structure of an upper case accommodating a contact point portion from a direction different from that in FIG. 2, FIG. 5 shows a state of mounting a fixed contactor in a terminal chamber of an upper case, FIG. 6 shows principal portions of a terminal chamber in which is mounted a fixed contactor, FIG. 7 shows the structure of a fixed contactor in one embodiment, FIG. 8 shows a state in which a screw with a washer is screwed into a fixed contactor, FIG. 9 shows the structure of the fixed contactor of an embodiment different from that of FIG. 7, and FIG. 10 shows a state in which the fixed contactor of FIG. 9 is mounted in a terminal chamber of an upper case.

As shown in FIG. 1, an electromagnetic contact device 10 of this embodiment is a device comprising terminal portions 12 each having contact points, and coil terminals 13*a* and 13*b*, and in which an electromagnet 15 is accommodated in a lower case 14 of a synthetic resin, and an upper case 16 of synthetic resin is mounted on an upper opening of the lower case 14. Terminal portions 12 each having contact points arranged on the front side of the upper case 16 in FIG. 1 are load-side terminals, and terminal portions (not shown) each having contact points are also arranged on the rear side of the upper case 16; these terminals are power supply-side terminals.

The electromagnet 15 comprises a coil frame (not shown) of synthetic resin, around which is wound an electromagnetic coil 17; a fixed core (not shown) fixed on a side wall of the lower case 14; a movable core (not shown), inserted into a hollow portion of the coil frame, opposing and enabling contact and separation with the fixed core; and a pair of coil terminal bases 18 and 19, separated and formed integrally on one end of the coil frame in which the movable core is arranged. Coil terminals 13*a*, 13*b* are respectively mounted on the pair of coil terminal bases 18, 19.

As shown in FIG. 2 to FIG. 4, in the upper case 16, a plurality of terminal chambers 20*a* to 20*e* on the load side and a plurality of terminal chambers 21 on the power supply side are provided in opposition on the rear face side; contact point portions 22 are accommodated in an accommodation space S provided between the load-side terminal chambers 20*a* to 20*e* and the power supply-side terminal chambers 21, and a cover 23 covering the accommodation space S is mounted on the upper case 16.

Here, as shown in FIG. 2 and FIG. 3, fixed contactor pressing portions 23*a* protruding toward the terminal chambers 20*a* to 20*e* are provided on the inside face of the cover 23.

A contact point portion 22 comprises a movable contact point support 22*a* of a synthetic resin, a return spring 22*b*, a plurality of movable contact points 22*c*, and a plurality of contact point springs (not shown). The movable contact point support 22*a* is arranged so as to move in parallel with the direction of motion of the movable core of the electromagnet 15, and a driving lever 22*a*1 provided on one side in the movement direction is linkably engaged with the movable core. The return spring 22*b* is arranged in the upper case 16 and acts with a spring urging force directed on one side of the movable contact point support 22*a*. The plurality of movable contact points 22*c* are arranged within the movable contact point support 22*a* and are each supported by a contact point spring (not shown), so as to enable movement in the same direction as the movable contact point support 22*a*. Further, the plurality of contact point springs are arranged so as to act with a spring urging force on each of the movable contact points 22*c* in the direction opposite the direction of action of the spring urging force of the return spring 22*b*.

Fixed contactors 31 are mounted in the load-side terminal chambers 20*a* to 20*e* as the above-described terminal portions 12, each having a contact point. The power supply-side terminal chambers and the fixed contactors mounted in these chambers have the same structure, so explanations are omitted.

The terminal chambers 20*a* to 20*e* are formed by using a plurality of first partition walls 24*a* to 24*e* to partition, in parallel and separated, as shown in FIG. 2 and FIG. 4; these terminal chambers 20*a* to 20*e* are provided in a space different from the accommodation space S by a second partition wall 25 formed to partition these from the accommodation space S.

As shown in FIG. 5, a press-fit space 26 and fixed contact point insertion space 27 are formed at positions in proximity to the first partition walls 24*a*, 24*b* in the terminal chamber 20*a*.

As shown in FIG. 5 and FIG. 6, the press-fit space 26 is a bursiform space enclosed by the first partition wall 24*a*, press-fit partition wall 28*a* rising up from the bottom face of the terminal chamber 20*a*, second partition wall 25, and front wall (wall opposing the second partition wall 25) 29, and open at the top. The second partition wall 25 and front wall 29 forming this press-fit space 26 are set so that the interval between partitions is narrow at the bottom and the interval between partitions broadens at the top, and as shown in FIG. 6, step faces 30*a*, 30*b* at places with different intervals between partitions are formed.

Further, the fixed contact point insertion space 27 is a space enclosed by the first partition wall 24*b*, press-fit partition wall 28*b* rising up from the bottom face of the terminal chamber 20*a*, second partition wall 25, and front wall 29, and communicates with the accommodation space S via a slit 25*a* formed in the second partition wall 25.

Further, in the other terminal chambers 20*b* to 20*e*, press-fit spaces 26 and fixed contact point insertion spaces 27 with the same structures as in the terminal chamber 20*a* are also formed.

As shown in FIG. 7, the fixed contactors 31 mounted in the terminal chambers 20*a* to 20*e* comprise a terminal screw 31*a* with a square shape in plane view, in which is formed a female screw hole; a press-fitted piece 31*b* formed by bending from one side of the terminal screw 31*a*; a bent piece 31*c* formed by bending from another side of the terminal screw 31*a* in the same direction as the press-fitted piece 31*b*; and a fixed contact point 31*d* formed at one end of the bent piece 31*c*.

The press-fitted piece 31*b* and bent piece 31*c* are made continuous with the terminal screw 31*a* via a pair of connecting rods 31*b*1, 31*b*2 and a pair of connecting rods 31*c*1, 31*c*2 by forming cutout openings 31*e*1, 31*e*2.

On the upper face of the terminal screw 31*a* is formed a wiring escape-preventing ridge 31*f* protruding in the radial direction.

Further, in the press-fitted piece 31*b* is provided a narrow portion 31*g*, the plate width dimension of which decreases suddenly from the pair of connecting rods 31*b*1, 31*b*2, and sawtooth-shape engaging teeth 31*h* are formed in the edge portion in the plate width direction, from this narrow portion 31*g* toward the end.

And, as shown in FIG. 8, a screw 33 with a washer 32 is screwed into the terminal screw 31*a* of this fixed contactor 31. Here, a groove 32*a* into which the wiring escape-preventing ridge 31*f* of the terminal screw 31*a* can enter is formed in the washer 32.

The press-fitted piece 31*b* and bent piece 31*c* of fixed contactors 31 with the above configuration are inserted into the press-fit spaces 26 and fixed contact point insertion spaces 27 of the terminal chambers 20*a* to 20*e*.

The sawtooth-shape engaging teeth 31*h* of the press-fitted pieces 31*b* are engaged while press-fitting with the inner faces of the second partition wall 25 and front wall 29, as shown in FIG. 6. At this time, the narrow portions 31*g* of the press-fitted pieces 31*b* oppose the step faces 30*a*, 30*b* formed in the press-fit space 26.

Further, when the bent piece 31*c* is inserted into the fixed contact point insertion space 27, one side of the bent piece 31*c* mates with the slit 25*a*, and the fixed contact point 31*d* formed on one end of the bent piece 31*c* is positioned in the accommodation space S, and is arranged opposing the front in the direction of motion of the plurality of movable contact points 22*c* of the contact point portion 22.

Further, as shown in FIG. 5, when the cover 23 is mounted on the upper case 16, the fixed contactor pressing portions 23*a* provided on the above-described cover 23 abut, from the upper face, the terminal screws 31*a* of the fixed contactors 31 mounted in the terminal chambers 20*a* to 20*e*.

And, when a voltage is applied to the electromagnetic coil 17 in the electromagnetic contact device 10 with the above configuration and the electromagnetic coil 17 is excited, the movable core moves toward the fixed core, the driving lever 22*a*1 moves together with motion of the movable core, and the movable contact point support 22*a* moves in the direction compressing the return spring 22*b*. When the movable contact point support 22*a* moves in the direction compressing the return spring 22*b*, the plurality of movable contact points 22*c* arranged on the movable contact point support 22*a* are pressed in contact with the fixed contact points 31*d* by the spring urging force of each contact point spring, and the plurality of movable contact points 22*c* and fixed contact points 31*d* enter the closed-path (ON) state.

Further, when excitation of the electromagnetic coil is stopped, the spring urging force of the return spring 22*b* presses the movable contact point support 22*a* and driving lever 22*a*1 to the original position, and the movable core also returns to the original position. And, when the movable contact point support 22*a* moves to the original position, the spring urging force of the plurality of contact point springs declines, and the plurality of movable contact points 22*c* and fixed contact points 31*d* enter the open-path (OFF) state.

The housing of this invention corresponds to the upper case 16, the terminals of this invention correspond to the terminal portions 12 each of which has a contact point, the partition walls of the invention correspond to the first partition walls 24*a* to 24*e*, the engaged portion of this invention corresponds to the press-fitted piece 31*b*, the press-fit engaging portion of this invention corresponds to the press-fit space 26, the engaging walls of this invention correspond to the second partition wall 25 and front wall 29, the space of this invention corresponds to the accommodation space S, the blocking portions of this invention correspond to the narrow portion 31*g* and step faces 30*a* and 30*b*, and the pressing portion of this invention corresponds to the fixed contactor pressing portions 23*a*.

By means of an electromagnetic contact device 10 with the above configuration, press-fitted pieces 31*b* of fixed contactors 31 are mounted by press-fitting into press-fit spaces 26 of the terminal chambers 20*a* to 20*e* formed in the upper case 16, but the engaging teeth 31*h* of the press-fitted piece 31*b* are engaged by press-fitting into the inner faces of the second partition wall 25 and front wall 29 forming the press-fit space 26. Hence escape of the fixed contactor 31 is prevented simply by press-fitting the fixed contactor 31 into the press-fit space 26, and mounting in the upper case 16 can be reliably performed.

Further, when the cover 23 is mounted on the upper case 16, the fixed contactor pressing portions 23*a* provided on the cover 23 abut the upper face of the terminal screws 31*a* of the fixed contactors 31 mounted in the terminal chambers 20*a* to 20*e*, so that escape of the fixed contactors 31 can be prevented even more reliably.

Here, when press-fitting the press-fit piece 31*b* of a fixed contactor 31 into a press-fit space 26, shavings occur due to press-fitting into the inner faces of the second partition wall 25 and front wall 29, but the narrow portion 31*g* of the press-fitted piece 31*b* opposes the step faces 30*a*, 30*b* formed in the press-fit space 26, and the shavings which occur are sealed within the press-fit space 26. Hence shavings do not intrude into contact point portions 22 or similar, and removal by air cleaning or similar is rendered unnecessary, so that tasks of installation of fixed contactors 31 can easily be performed, and the reliability of contact of the movable contact points 22*c* of the contact portion 22 and the fixed contact points 31*d* can be improved.

Further, a dedicated portion (boss or similar) for preventing escape of fixed contactors 31 is not formed in the upper case 16 of this embodiment, as in a device of the prior art, so that the manufacturing cost of the upper case 16 can be reduced.

Further, in this embodiment, fixed contactors 31 are continuous with the press-fitted pieces 31*b* and bent pieces 31*c* via cutout openings 31*e*1, 31*e*2 and with the terminal screws 31*a*, so that bending of the press-fitted pieces 31*b* and bent pieces 31*c* is easy, and a flat plate-shape terminal screw 31*a* can be formed.

Also, wiring escape-preventing ridges 31*f* are formed on the terminal screws 31*a* of the fixed contactors 31, so that when screwing screws 33 into terminal screws 31*a* and connecting external wiring, wiring can be performed reliably by clamping external wiring using washers 32, and external wiring connection tasks can easily be performed.

Next, FIG. 9 shows the structure of a fixed contactor in another embodiment, and FIG. 10 shows the structure of a terminal chamber in which the fixed contactor of another embodiment is mounted.

As shown in FIG. 9, the fixed contactor 34 of this embodiment comprises a terminal screw 34*a* with a square shape in plane view; a press-fitted piece 34*b* formed by bending from one side of the terminal screw 34*a*; a bent piece 34*c* formed by bending from another side of the terminal screw 34*a* and shifted 90° from the position of formation of the press-fitted piece 34*b* in the same direction as the press-fitted piece 34*b*; and a fixed contact point 34*d* formed at one end of the bent piece 34*c*.

Sawtooth-shape engaging teeth 34*h* are formed on an edge in the plate thickness direction of the press-fitted piece 34*b*.

Further, in this embodiment the terminal chamber 20*a*, a bursiform press-fit space 37 opening at the top is formed by the first partition wall 24*a*, front wall (wall opposing the second partition wall 25) 35, press-fit partition wall 36 in proximity to this front wall 35, and press-fit partition wall 28*b* in proximity to the first partition wall 24*b*. Further, a fixed contact point insertion space 27 is formed at a position in proximity to the first partition wall 24*b* of the terminal chamber.

In this embodiment, the press-fitted piece 34*b* and bent piece 34*c* of a fixed contactor 34 are inserted into a press-fit space 37 and fixed contact point insertion space 27 of a terminal chamber 20*a*.

As shown in FIG. 10(*b*), the sawtooth-shape engaging teeth 34*h* of the press-fitted piece 34*b* are engaged while press-fitting into the inner faces of the first partition wall 24*a* and press-fit partition wall 28*b*.

Further, when the bent piece 34*c* is inserted into the fixed contact point insertion space 27, one side of the bent piece 34*c* mates with the slit 25*a*, and the fixed contact point 34*d* formed on one end of the bent piece 34*c* is positioned in the accommodation space S, and is arranged opposing the front in the direction of motion of the plurality of movable contact points 22*c* of the contact point portion 22.

The engaged portion of this invention corresponds to the press-fitted piece 34*b*, the press-fit engaging portion of this invention corresponds to the press-fit space 37, and the engaging wall of this invention corresponds to the first partition wall 24*a* and the press-fit partition wall 28*b*.

By means of this embodiment, the press-fitted piece 34*b* of a fixed contactor 34 is press-fit into the press-fit space of a terminal chamber 20*a* and mounted, but the engaging teeth 34*h* of the press-fitted piece 34*b* are press-fit into the inner faces of the first partition wall 24*a* and press-fit partition wall 28*b* forming the press-fit space 37 while being engaged. Hence simply by press-fitting the fixed contactor 34 into the press-fit space 37, escape of the fixed contactor 34 is prevented, and reliable mounting on the upper case 16 can be performed.

EXPLANATION OF REFERENCE NUMERALS

24*a* to 24*e* Partition wall
10 Electromagnetic contact device
12 Terminal portion
13*a*, 13*b* Coil terminal
14 Lower case
15 Electromagnet
16 Upper case
17 Electromagnetic coil
18, 19 Coil terminal base
20*a* to 20*e* Terminal chamber
22*a* Movable contact point support
22*a*1 Driving lever
22*b* Return spring
22*c* Movable contact point
23 Cover
23*a* Fixed contactor pressing portion
24*a* to 24*e* First partition wall
25 Second partition wall
25*a* Slit
26 Press-fit space
27 Fixed contact point insertion space
28*a*, 28*b* Press-fit partition wall
29 Front wall

30*a*, 30*b* Step face
31 Fixed contactor
31*a* Terminal screw
31*b* Press-fitted piece
31*c* Bent piece
31*d* Fixed contact point
31*e*1, 31*e*2 Cutout opening
31*f* Wiring escape-preventing ridge
31*g* Narrow portion
31*h* Engaging tooth
32 Washer
32*a* Groove
34 Fixed contactor
34*b* Press-fitted piece
34*c* Bent piece
34*d* Fixed contact point
34*h* Engaging tooth
35 Front wall
36 Press-fit partition wall
37 Press-fit space
S Accommodation space

What is claimed is:

1. An electromagnetic contact device, comprising:

a housing including power supply-side terminals and load-side terminals opposing to each other on a rear face side thereof, a movable contact point support accommodated in a space between the terminals thereof, a plurality of terminal chambers, each being defined by two partition walls facing each other and two engaging walls facing each other, each terminal chamber having a press-fit engaging portion and a fixed contact point insertion space respectively defined by press-fit partition walls, and fixed contactors each having a fixed contact point, a terminal screw mounted as the terminal in the terminal chambers, an engaged portion, and a bent piece, said engaged portion and the bent piece being inserted into the press-fit engaging portion and the fixed contact point insertion space, respectively, to fix the fixed contactor, wherein the engaged portion is formed integrally in each of the fixed contactors, and the press-fit engaging portion for engaging the engaged portion by press-fitting is arranged in each terminal chamber as another space different from the space accommodating the movable contact point support.

2. An electromagnetic contact device according to claim 1, wherein the press-fit engaging portion has a press-fit space defined by the engaging wall for the engaged portion, and the engaged portion has an engaging tooth for press-fitting into the engaging wall.

3. An electromagnetic contact device according to claim 2, wherein at least one of the engaged portion and the press-fit engaging portion has a blocking portion for blocking the press-fit space in which the engaged portion is press-fit into the press-fit engaging portion.

4. An electromagnetic contact device according to claim 3, wherein the blocking portion includes at least one of a narrow portion and step faces facing the narrow portion; the narrow portion is formed in the engaged portion, the engaging tooth being formed between the narrow portion and a bottom end of the engaged portion, and the step faces are formed to have different intervals between the engaging walls in the press-fit engaging portion.

5. An electromagnetic contact device according to claim 1, further comprising an escape-preventing portion for preventing each of the fixed contactors, in which the engaged portion is press-fit into the press-fit engaging portion, from escaping in a direction opposite to a press-fitting direction.

6. An electromagnetic contact device according to claim 5, wherein the housing comprises a cover blocking the space between the terminals, and said cover comprises a pressing portion abutting against the terminal screw of each of the fixed contactors and functioning as the escape-preventing portion.

7. An electromagnetic contact device according to claim 1, wherein one of the engaging walls adjacent to the space between the terminals has a slit; and the bent piece has the fixed contact point at one end thereof and is fitted in the slit such that the fixed contact point is located in the space between the terminals.

8. An electromagnetic contact device according to claim 1, wherein the bent piece has the fixed contact point at one end thereof and the bent piece projects toward the space between the terminals such that the fixed contact point is located in the space between the terminals.

9. An electromagnetic contact device according to claim 8, wherein the terminal screw, the engaged portion and the bent piece are integrally formed as one member, and the engaged portion and the bent piece faces each other through the terminal screw.

10. An electromagnetic contact device according to claim 8, wherein the terminal screw, the engaged portion and the bent piece are integrally formed as one member, and the engaged portion and the bent piece are arranged in a direction perpendicular each other through the terminal screw.

* * * * *

UNITED STATES PATENT AND TRADEMARK OFFICE

CERTIFICATE OF CORRECTION

PATENT NO. : 8,350,647 B2
APPLICATION NO. : 13/138927
DATED : January 8, 2013
INVENTOR(S) : Kouetsu Takaya et al.

It is certified that error appears in the above-identified patent and that said Letters Patent is hereby corrected as shown below:

In the Specification;

Please change column 6, line 53, "electromagnetic coil is" to --electromagnetic coil 17 is--.

Please change column 8, line 33, "space of" to --space 37 of--.

Signed and Sealed this
Sixteenth Day of July, 2013

Teresa Stanek Rea
*Acting Director of the United States Patent and Trademark Office*